United States Patent. [19]

Langford

[11] Patent Number: 5,037,012

[45] Date of Patent: Aug. 6, 1991

[54] VALVE FOR AN AEROSOL DISPENSER

[75] Inventor: Alan K. Langford, Hoddesdon, Great Britain

[73] Assignee: Harris Pharmaceuticals Limited, London, Great Britain

[21] Appl. No.: 479,926

[22] Filed: Feb. 14, 1990

[30] Foreign Application Priority Data

Jul. 28, 1989 [GB] United Kingdom ..... 8917285

[51] Int. Cl.[5] ..... B65D 83/00

[52] U.S. Cl. ..... 222/402.2; 222/459; 239/463

[58] Field of Search ..... 222/402.2, 402.24, 459, 222/514, 402.18, 564; 239/463; 366/225, 228, 229

[56] References Cited

U.S. PATENT DOCUMENTS

| | | | |
|---|---|---|---|
| 3,053,459 | 9/1962 | Corsette | 239/463 X |
| 3,341,089 | 9/1967 | Pearsall | 222/459 |
| 3,730,224 | 1/1973 | Prisk | 222/564 X |
| 4,135,648 | 1/1979 | White | 222/402.2 |
| 4,702,400 | 10/1987 | Corbett | 222/402.2 |
| 4,863,073 | 9/1989 | Burt et al. | 222/402.2 |
| 4,944,433 | 7/1990 | Knecht et al. | 222/564 X |

FOREIGN PATENT DOCUMENTS

| | | | |
|---|---|---|---|
| 962062 | 6/1964 | United Kingdom | 222/464 |
| 2206099 | 12/1988 | United Kingdom | 222/402.2 |

*Primary Examiner*—Michael S. Huppert
*Assistant Examiner*—Gregory L. Huson
*Attorney, Agent, or Firm*—Armstrong, Nikaido, Marmelstein, Kubovcik, & Murray

[57] ABSTRACT

An aerosol metering valve with for use with a pressurized container includes a valve body 10 having a metering cup 8, a valve stem 21 having an outlet passage through which the contents of the metering cup 8 can be dispensed, a transfer passage 22 through which the contents of the metering chamber 31 can pass to the outlet passage, and a passageway including ports 35 and 37 through which contents of the container can pass to the metering chamber. A valve seal 6 is disposed between the valve body 10 and a container. A second valve seal 12 is retained between a cup 8 and the valve body. A ring member 38 is positioned coaxially with respect to the valve retaining member and is provided with castellating slots 40.

10 Claims, 2 Drawing Sheets

FIG. 1
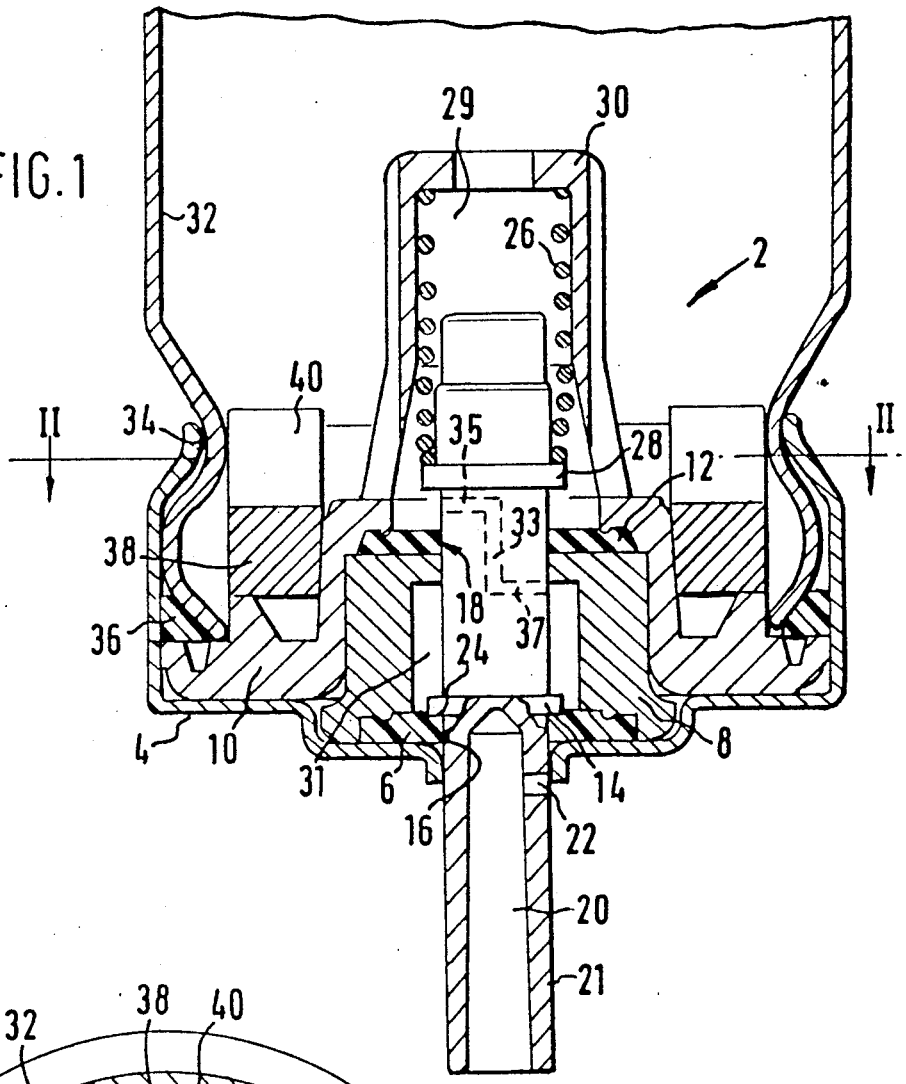
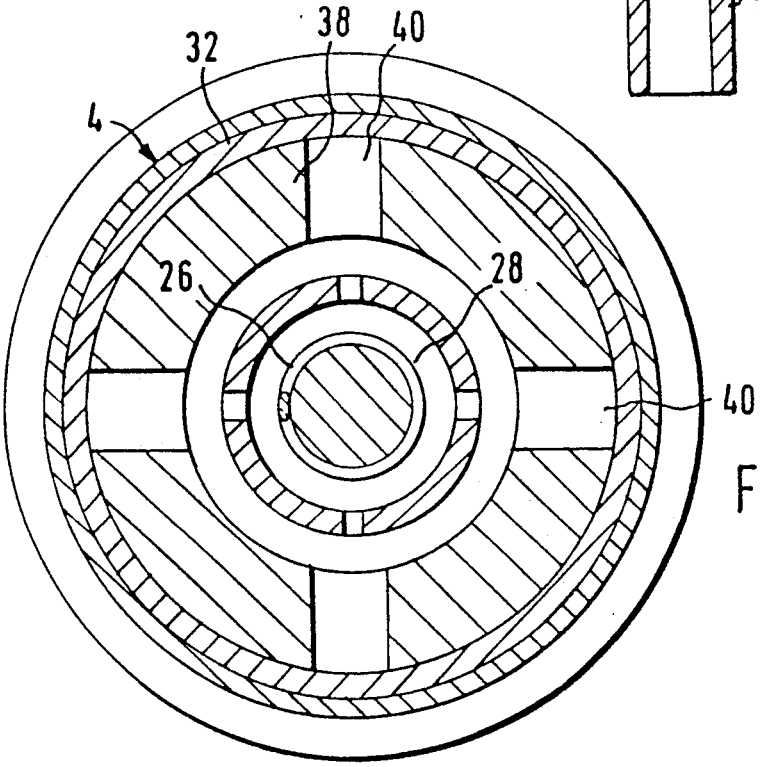
FIG. 2

VALVE FOR AN AEROSOL DISPENSER

This invention relates to valves for aerosol dispensers and is particularly concerned with such valves which dispense a metered dose at each operation.

According to the present invention there is provided an aerosol metering valve for use with a pressurized container, the valve comprising a valve body having a metering chamber, a valve stem having an outlet passage through which contents of the metering chamber can be dispensed; a transfer passage through which contents of the metering chamber can pass to the outlet passage when the valve is in an operative position; a passageway formed in the valve stem through which the contents of the container can pass into the metering chamber when the valve is in an inoperative position; a first valve seal disposed between the valve body and the container and through which the valve stem is sealingly slideable in an axial direction; a valve retaining member sealingly mounted within the container and having a second valve seal through which the valve stem is sealingly slideable in an axial direction; a ring member positioned coaxially with respect to the valve retaining member and being provided with castellations on at least one face thereof; and a spring member acting to yieldingly retain the valve stem in an inoperative position.

In a preferred arrangement the castellated ring member is made of nylon.

An embodiment of the invention will now be described with reference to the accompanying drawings in which:

FIG. 1 is a section view through an aerosol container and a valve according to the invention;

FIG. 2 is a section on the line II—II of FIG. 1;

Figure 3:
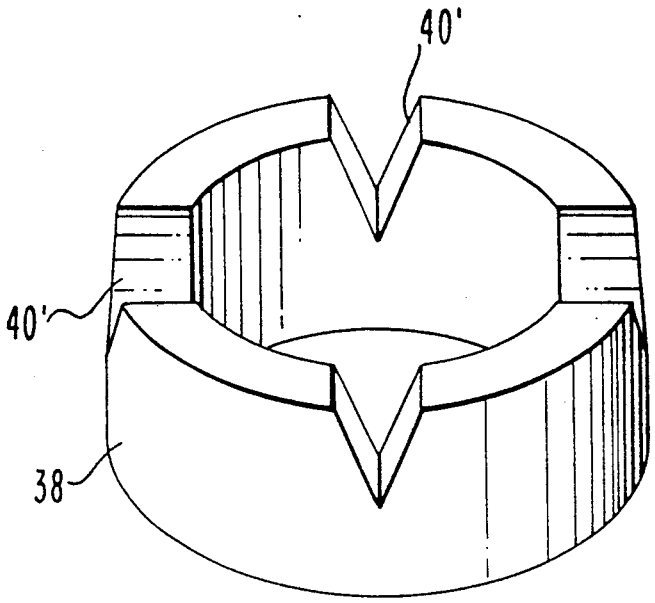
FIG. 3 is a perspective view of an alternate component of the valve of FIG. 1.

As seen in the drawings a valve 2 comprises a cover such as a cap or ferrule 4 and an elastomeric valve seal 6 positioned between the cap 4 and a metering cup 8. The metering cup 8 is positioned axially within a valve body 10 and a second elastomeric valve seal 12 is retained between the cup 8 and the valve body. A valve member 14 is a sealing fit within axial bores 16 and 18 in the seals 6 and 12 respectively and an outlet passage 20 is provided within a valve stem 21. A transfer port 22 is formed in one wall of the valve stem and a shoulder 24 on the valve member 14 is urged against the seal 6 by a compression spring 26 acting between an annular flange 28 on the valve member 14 and the end of a bore 29 in an extension 30 formed as part of the valve body 10.

The metering cup 8 is formed with a metering chamber 31 and a hole 33 connects that chamber via ports 35 and 37, with the interior of the dispenser when the valve is in its closed position so that the contents may pass into the chamber as a metered dose.

The side wall 32 of the presurized dispenser is retained with the cap or ferrule 4 as shown by crimping at 34 and sealingly engages an elastomeric sealing ring 36 to prevent unwanted egress of the contents of the dispenser.

A nylon collar 38 is fitted tightly around the valve body 10 and is provided with castellating slots 40, and retention of the collar is assisted by the crimped wall 32

Figure 4:
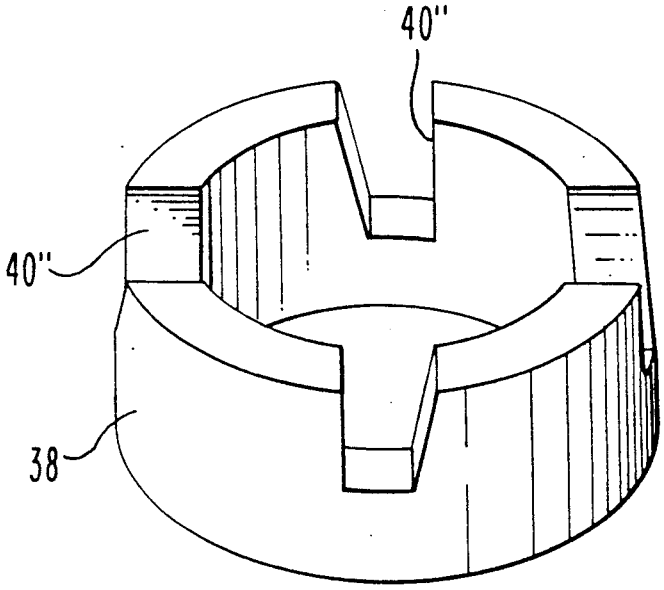
FIG. 4 is a perspective view of a further alternate component of the valve of FIG. 1.

The castellating slots 40 may be of rectangular form, or of any other desired shape, such as the V-shaped slots 40' or buttress form slots 40'' as shown by FIGS. 3 and 4, respectively. The collar 38 acts as a static mixer for the contents of the dispenser.

When the contents of the cannister consist of a suspension of finely divided solids in a liquid or an emulsion they need to be agitated to ensure that a homogeneous sample of the mixture enters the chamber 31.

Thus the castellated collar 38 acts on the horizontally swirling liquid to produce a vertical mixing action around the zone of entry into the metering chamber.

In use, the dispenser is inverted as shown in the drawing and the contents of the container flow through the hole 33 into the metering chamber 31, the contents of the chamber constituting a measured dose. Axial pressure on the valve stem 21 causes the stem to partially retract into the valve body 10 against the action of the spring 26 and the port 37 is moved upwardly through the metering cup 8 effectively cutting off the connection between the chamber 31 and the contents of the container. At the same time the transfer port 22 is moved upwardly through the elastomeric seal 12 into the metering chamber 31 and the metered dose within that chamber passes into the outlet passage 20 in the conventional way.

I claim:

1. An aerosol metering valve for use with a pressurized container, the valve comprising:

a valve body having a metering chamber;

a valve member having an outlet passage through which contents of the metering chamber can be dispensed;

a transfer passage through which contents of the metering chamber can pass to the outlet passage when the valve member is in an operative or actuated position;

a passageway formed in the valve member through which the contents of the container can pass from the container into the metering chamber when the valve is in an inoperative or rest position;

a first valve seal disposed between the valve body and the container and through which the valve member is sealingly slidable in an axial direction to isolate the transfer passage from the metering chamber when the valve is in said operative or rest position;

a valve retaining member sealingly mounted within the container and having a second valve seal through which the valve member is sealingly slidable in an axial direction and which isolates the passageway from the metering chamber;

a ring member positioned co-axially with respect to the valve retaining member and having slots providing castellations on at least one face thereof; and a spring member acting to yieldingly retain the valve member in an inoperative position.

2. An aerosol metering valve according to claim 1 where the castellating slots are of rectangular form.

3. An aerosol metering valve according to claim 1 where the castellating slots are V-shaped.

4. An aerosol metering valve according to claim 1 where the castellating slots are of buttress form.

5. An aerosol metering valve according to claim 1 where the ring member is provided as a collar capable of acting on liquid around the metering chamber to produce a mixing action of said liquid.

6. An aerosol metering valve according to claim 1 where the ring member is retained within a cover by crimping of a wall of the presurized container.

7. An aerosol metering valve according to claim 1 where the castellated ring member is made of nylon.

8. An aerosol metering valve according to claim 7 where the castellating slots are of rectangular form.

9. An aerosol metering valve according to claim 7 where the castellating slots are V-shaped.

10. An aerosol metering valve according to claim 7 where the castellating slots are of buttress form.

* * * * *